United States Patent [19]

Thomsen

[11] Patent Number: 4,892,124

[45] Date of Patent: Jan. 9, 1990

[54] CROSS-CUTTING APPARATUS AND CONVEYOR FOR BAG FILLING MACHINES

[76] Inventor: Peter N. Thomsen, 138 Baumont Ave., San Francisco, Calif. 94118

[21] Appl. No.: 280,710

[22] Filed: Dec. 6, 1988

[51] Int. Cl.[4] ..... B65B 43/42; B65B 3/16

[52] U.S. Cl. ..... 141/114; 141/165; 141/168; 141/313; 53/300; 53/381 A; 53/384; 53/570

[58] Field of Search ..... 141/10, 313, 314; 30/DIG. 8; 53/570, 250

[56] References Cited

U.S. PATENT DOCUMENTS

| | | | |
|---|---|---|---|
| 4,297,929 | 11/1981 | Schiesser et al. | 53/570 X |
| 4,386,636 | 6/1983 | Ellert | 141/10 |
| 4,510,737 | 4/1985 | Ellert | 53/570 |
| 4,574,559 | 3/1986 | Rutter et al. | 53/381 A |
| 4,620,411 | 11/1986 | Schiesser et al. | 53/570 |
| 4,676,285 | 6/1987 | Schiesser et al. | 141/114 |

*Primary Examiner*—Ernest G. Cusick

*Attorney, Agent, or Firm*—Phillips, Moore, Lempio & Finley

[57] ABSTRACT

A bag filling machine, adapted to fill a plastic bag with a liquid product through a gland secured to the bag, comprises a conveyor for intermittently moving a series of the bags along a path. Adjacent pairs of the bags are connected together at a severable parting line, extending transversely relative to the path, and a cutting apparatus is adapted to sever the parting line. The apparatus comprises generally horizontally disposed first and second platens, spaced apart to define an opening therebetween, and extending transversely relative to the path of movement of the bags. Clamping bars are movably mounted above the platens to engage and clamp each adjacent pair of leading and trailing bags to the platens and to position the severable parting line over the opening defined between the platens. A cutter is slidably mounted in the apparatus for severing the parting line connecting the bags together. Each separated bag is then delivered by the conveyor to a filling station to have a liquid product dispensed therein, through the gland.

12 Claims, 4 Drawing Sheets

13
14
G
40
38
16
12
47
42
28
18
23
17
33
27
31
33'
46
43
44
45
15
37'
25
21
32'
39
41
11
34
19

30
18
37
26
22
32
G
24
31
31'
20
10
13

CROSS-CUTTING APPARATUS AND CONVEYOR FOR BAG FILLING MACHINES

TECHNICAL FIELD

This invention relates generally to a bag filling machine used for liquid packaging systems and more particularly to a cutting apparatus for severing a parting line connecting adjacent pairs of bags together.

BACKGROUND OF THE INVENTION

Liquid filling and packaging machines are adapted to fill plastic bags with a liquid product, such as milk or wine. Heretofore, the bags have been pre-cut and then conveyed separately to a filling station for the purpose of filling each bag with a liquid product, through an open gland secured to the bag. On many such machines, the individual bags are hand-fed and held during the filling operation. In machines wherein the individual bags are conveyed through the machine, various alignment and related problems arise in respect to properly positioning the separated bags for filling purposes.

SUMMARY OF THE INVENTION

An object of this invention is to provide an improved and highly efficient cross-cutting apparatus, conveyor and method for severing a parting line connecting each adjacent pair of bags together and for conveying each separated bag to a filling station.

The cutting apparatus comprises generally horizontally disposed first and second platens mounted on a frame of the apparatus and spaced apart in the direction of a path of movement of the bags to define an opening therebetween, extending transversely relative to such path. Clamping means, movably mounted above the platens, engage and clamp a leading end of a trailing bag and a trailing end of a leading bag of each adjacent pair of bags to the first and second platens, respectively, to position the severable parting line over the opening between the platens. Cutting means, mounted on the frame, severs the parting line between the bags to separate them from each other by moving a cutting blade in a horizontal plane and transversely.

In another aspect of this invention, the conveyor comprises a fluid-actuated cylinder having a hook adapted to intermittently move the bags to the cutting apparatus and each separated bag to the filling station.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
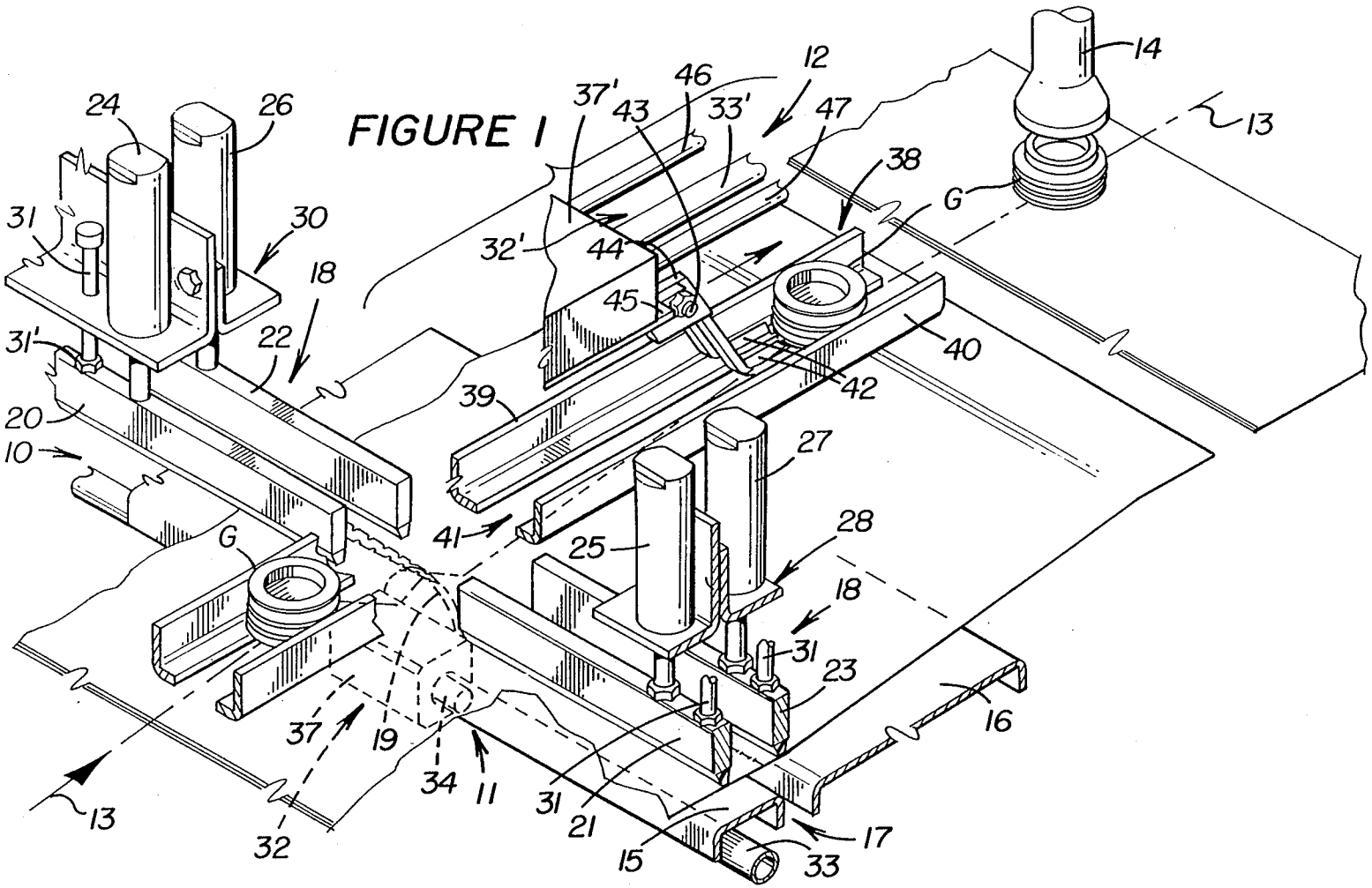
FIG. 1 is an isometric and sectioned view, partially illustrating a bag filling machine.

FIG. 1 partially illustrates a bag filling machine 10 having a cutting apparatus 11 of this invention mounted on a stationary frame of the machine. As described more fully hereinafter, a conveyor 12 is mounted on the frame for intermittently moving a connected series of laminated plastic bags B along a generally linear path 13. The bags are adapted to be individually delivered by a conveyor to a filling station, including a fill tube 14, whereat each bag is filled with a liquid product, such as milk, wine or fruit juices.

Figure 5:
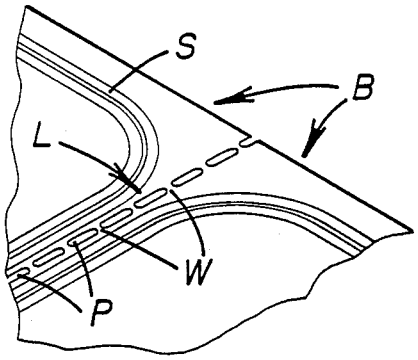
FIG. 5 partially illustrates a severable parting line between a pair of adjacent bags, adapted to be severed by the cutting apparatus.

Referring briefly to FIG. 5, each adjacent pair of bags are connected together at a severable parting line L, extending transversely relative to path 13, with the parting line including a series of perforations P separated by webs W. Each bag may comprise a pair of overlying panels heat sealed together about their peripheries at a seam S. Each bag has a gland G secured thereto (FIG. 1), adapted to cooperate with fill tube 14 for bag-filling purposes.

Figure 2:
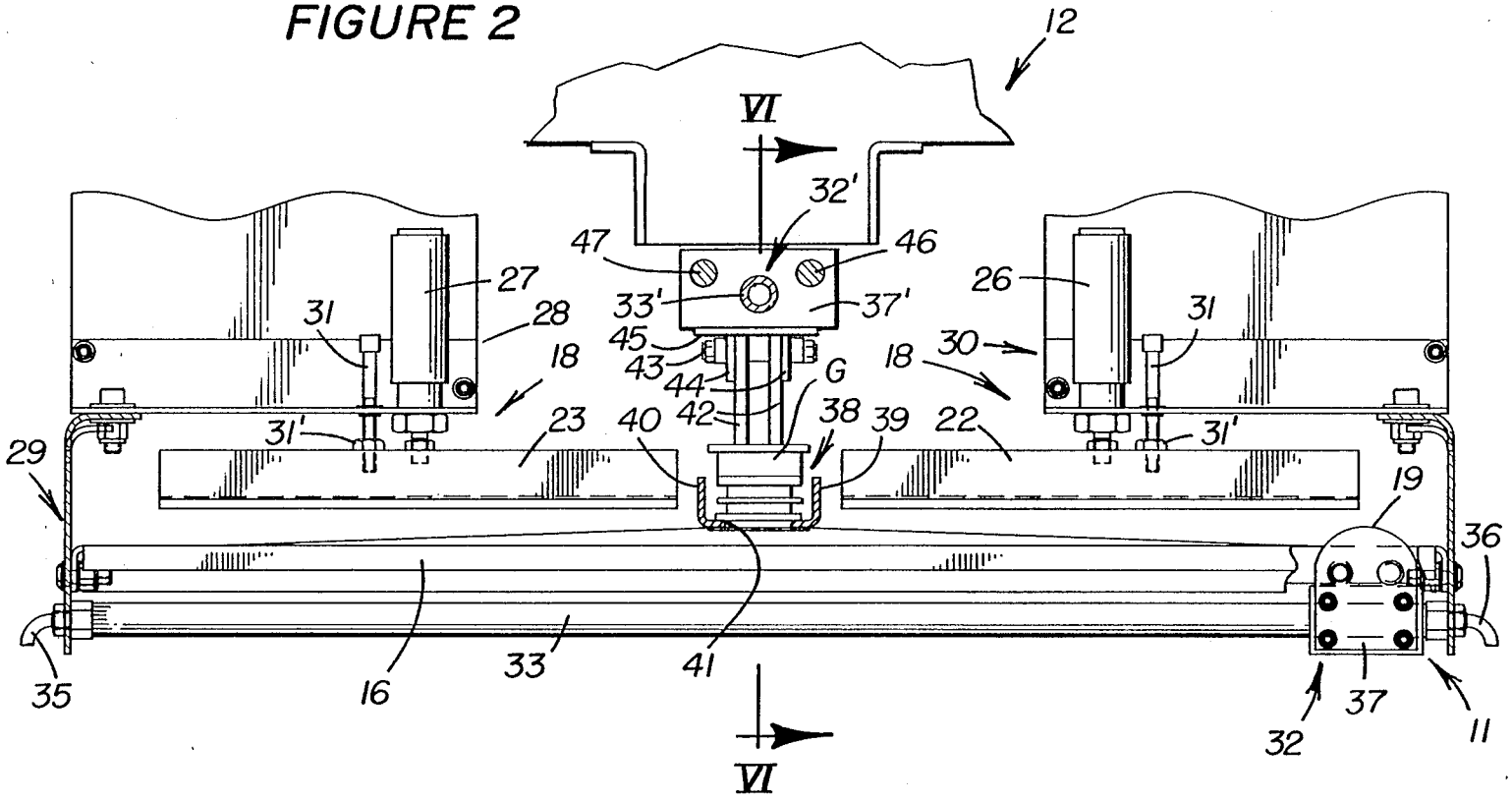
FIG. 2 is a cross-sectional view through the machine, illustrating a cutting apparatus for severing a parting line between each pair of adjacent bags.
Figure 4:
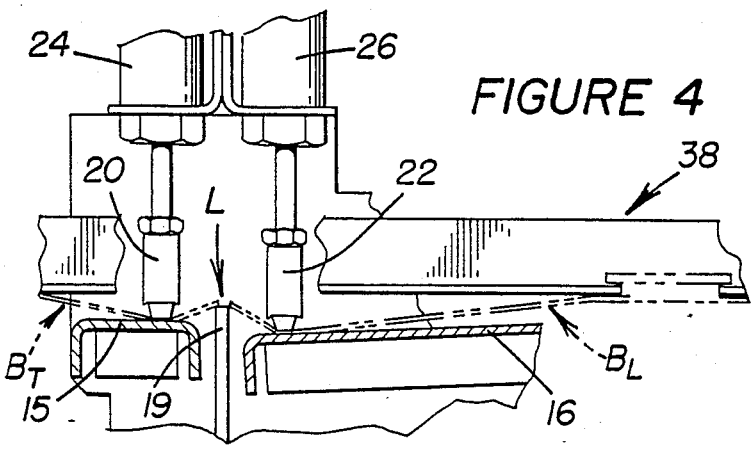
FIG. 4 is a view similar to FIG. 3, but illustrates the clamping bars in their lowered, clamping positions.

Referring to FIGS. 1 and 2, cutting apparatus 11 includes generally horizontally disposed first and second platens 15 and 16, respectively, spaced apart in the direction of path 13 to define an elongated opening 17 between the platens, extending transversely relative to the path. Clamping means 18 are mounted above platens 15 and 16 for engaging and clamping a leading end of a trailing bag and the trailing end of a leading bag of an adjacent pair of connected bags to platens 15 and 16, respectively (FIG. 4). Severable parting line L, connecting the bags together, is thus placed over opening 17. As described more fully hereinafter, a cutting blade 19 is then moved in a horizontal plane containing path 13 and transversely through the parting line to tear webs W (FIG. 5) and thus sever the bags from each other.

Figure 3:
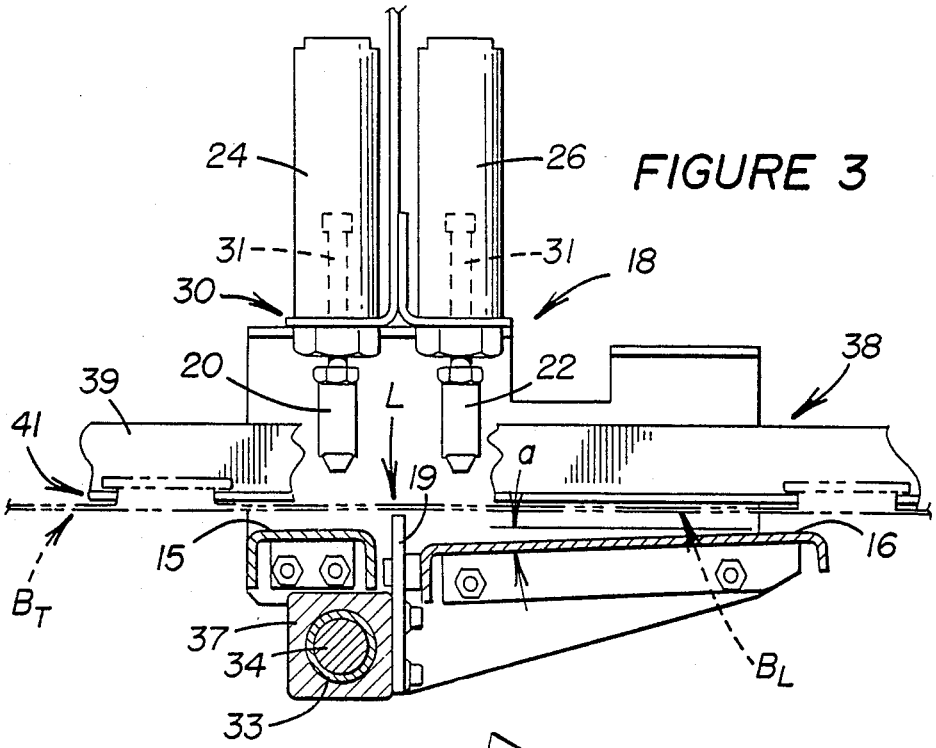
FIG. 3 is an enlarged sectional view through the cutting apparatus (generally taken in the direction of arrows VI—VI in FIG. 2) showing a pair of clamping bars in their raised positions.

Referring to FIGS. 1–3, clamping means 18 comprises a pair of laterally spaced first clamping bars 20 and 21 extending in alignment over platen 13, transversely relative to path 13. A pair of laterally spaced second clamping bars 22 and 23 extend in alignment over platen 16 in parallel relationship relative to clamping bars 20 and 21. Extensible and retractable fluid-actuated cylinders 24–27 are mounted on the frame of the machine and connected to clamping bars 20–23, respectively. The cylinders are simultaneously actuated to move the clamping bars between their raised positions (FIG. 3) and their lowered, clamping positions (FIG. 4) when conveyor 12 stops to place parting line L over opening 17. Each standard cylinder may be air-actuated, either of the well-known double acting or spring return type.

As shown in FIGS. 1 and 2, cylinders 25 and 27 are commonly mounted on a support bar 28, mounted in cantilevered relationship on a stationary main frame 29 of the machine (FIGS. 2 and 6) to extend over one lateral side of platens 15 and 16. Cylinders 24 and 26 are mounted in a like manner on a support bar 30, extending in cantilevered relationship over the opposite side of the platens. The cylinders are suitably integrated into the machine's main control system (not shown) in a manner well-known to those skilled in the arts relating hereto.

As further shown in FIGS. 1 and 2, a bolt 31 is threadably mounted to support bar 30 and has its distal end threadably mounted to clamping bar 20 to provide means interconnected between the support and clamping bar to prevent swinging movements of the clamping bar, about the vertical axis of cylinder 24. One or more lock nuts 31' can be suitably threaded on the distal end of the bolt to secure the bolt in its fixed, adjusted position. It should be noted that identical bolts 31 are suitably arranged in the manner described above to also prevent swinging movement of clamping bars 21–23.

Still referring to FIGS. 1 and 2, cutting blade 19 may be of the "blunt" type for severing (tearing) parting line L at webs W (FIG. 5) when conveyor 12 has stopped to position the parting line over opening 17. The means for intermittently moving the cutting blade through the horizontal plane containing path 13 may comprise a standard actuator 32 of the type manufactured by SMC Pneumatics, Inc. of Indianapolis, Ind. under Model No. NCY1B15H (SMC Rodless Cylinder Series NCY1). Standard actuators of this type comprise a tube 33 having a double-acting piston 34 slidably mounted therein and adapted to have opposite ends alternately pressurized by conduits 35 and 36, at respective ends of the tube (FIG. 2). Cutting blade 19 is suitably secured to a slider 37, bearing-mounted for sliding movements on the tube.

In operation, rare earth magnets (not shown) secured to piston 34 and disposed internally of tube 33 and also secured externally of the tube on slider 37 will co-act through tube to move the slider and cutting blade along the tube when the tube is air-pressurized at one end and simultaneously relieved of pressure at its opposite end. For example and as shown in FIG. 2, pressurization of the tube via conduit 36 and relief of air pressure via conduit 35 will function to simultaneously move piston 34 and slider 37 leftwardly to severe the parting line connecting an adjacent pair of bags together, by cutting blade 19. The operation is reversed to sever the next-following parting line.

Figure 6:
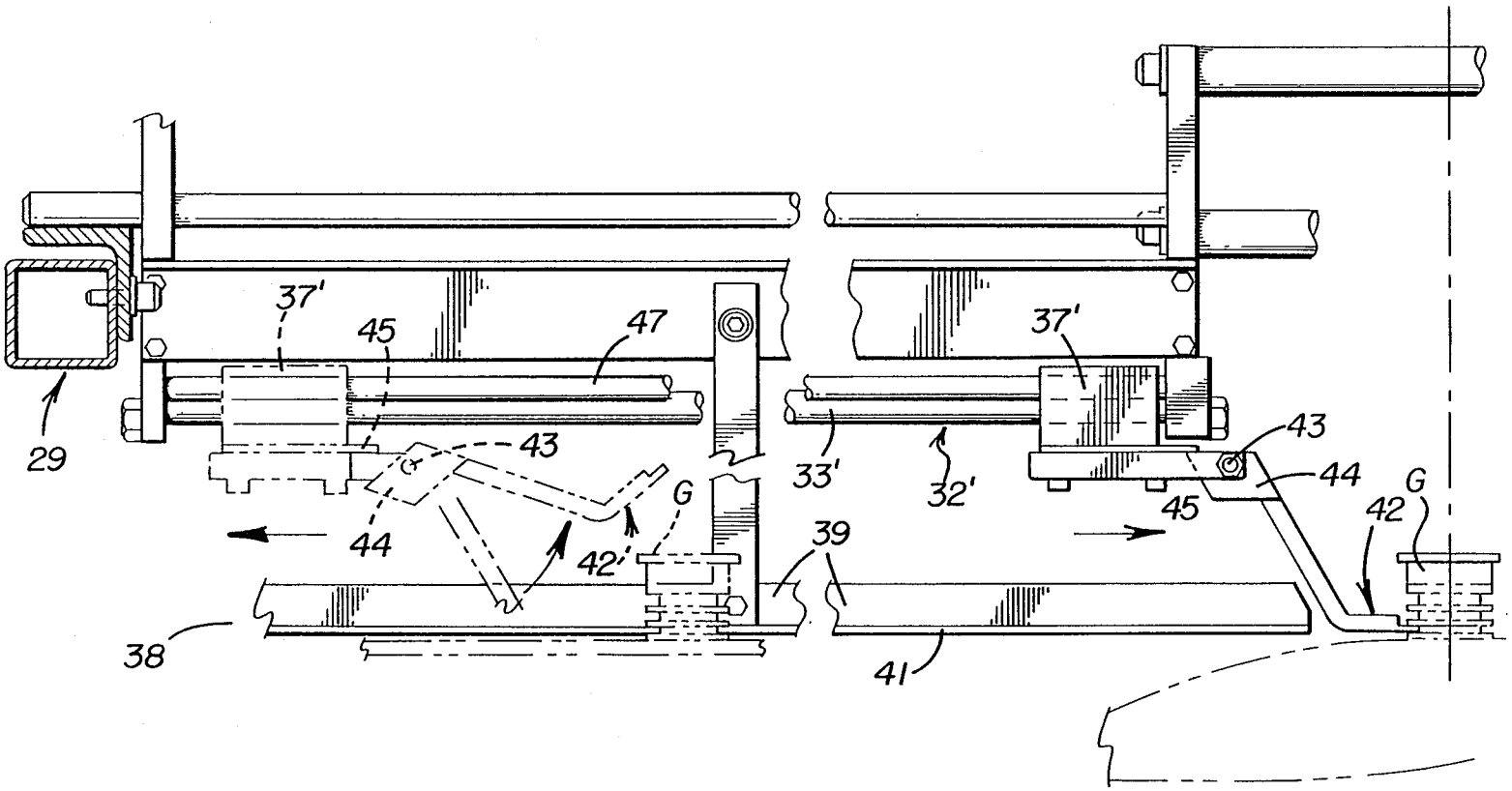
FIG. 6 is a cross-sectional view through the machine, taken in the direction of arrows VI—VI in FIG. 2, illustrating a conveyor for intermittently moving the bags through the cutting apparatus and to a filling station.

As shown in FIGS. 1 and 6, conveyor 12 includes a guide means 38 secured on main frame 29 of the machine to overlie platens 15 and 16 and extend in direction of path 13. The guide means comprises a pair of laterally spaced angle bars 39 and 40, defining an open guide track 41 therebetween sized to engage and guide movements of annular gland G along the path. The bars are positioned laterally between pairs of clamping bars 20,22 and 21,23 so as not to interfere with the clamping action of the bars.

FIGS. 1, 2 and 6 also illustrate an actuator 32' of conveyor 12, similar in construction and function to actuator 32. In particular, the actuator comprises a tube 33' having a piston (not shown) reciprocally mounted therein and a slider 37', slidably mounted on rods 46 and 47, secured to a bifurcated hook 42. When the proximal end of the actuator's tube is pressurized with air and the distal end thereof relieved of pressure, hook 42 will engage gland G to move the web of bags to a position whereat a particular severable parting line L will overlie opening 17.

A bolt 43 pivotally mounts laterally spaced plates 44 on the forward end of slider 37' with hook 42 being secured between the plates to extend forwardly thereof. As shown in FIGS. 1 and 6, when the hook is in its lowered, operational position to engage gland G, plates 44 engage beneath a plate 45 secured on slider 37' to provide stop means delimiting further clockwise pivoting of the hook.

After the cutting operation has been completed, actuator 32' is again pressurized to move the separated bag to the filling station and vertically align gland G with fill tube 14 (FIG. 6). The actuator is then retracted to ready it for a subsequent intermittent operation with hook 42 freely pivoting counterclockwise in FIG. 6 (phantom-line position) for engagement behind the next-following gland. Actuator 32' may be of the slider type, also manufactured by SMC Pneumatics, Inc. of Indianapolis, Ind. under Model No. NCDY1S15H. Alternatively, the actuators could be of the well-known linear motor (Sawyer) type.

In carrying forth the method steps of this invention, the continuous web of plastic bags B is moved by hook 42 of conveyor 12 along path 13 and stopped to position a severable parting line L intermediate opening 17. Actuator 32' of the conveyor remains in its first stage of extension until the cutting operation has been completed. Fluid cylinders 23–26 are then actuated and extended to move clamping bars 20–23 downwardly simultaneously for clamping the connected adjacent pair of bags to platens 15 and 16 (FIG. 4). Actuator 32 is then pressurized to move cutting blade into engagement with parting line L to severe (tear) webs W thereof (FIGS. 1 and 5).

As shown in FIGS. 1 and 4, downstream clamping bars 20 and 21 clamp a leading end of a trailing bag BT of the pair of bags to platen 15 whereas upstream clamping bars 22 and 23 clamp a trailing end of a leading bag BL thereof to platen 16. As further shown in FIG. 4, platen 16 has its downstream end spaced vertically below horizontally disposed platen 15 to ensure that the leading edge of the trailing bag will ride-up onto platen 16. Platen 16 may be disposed at an acute angle "a" (e.g. 5°) relative to a horizontal plane to provide such vertical displacement.

After each bag has been separated, actuator 32' moves to its second stage of extension to move the bag to the filling station whereat it is filled through gland G by fill tube 14 in a conventional manner (FIGS. 1 and 6). As described above, the actuator is then retracted to engage hook 42 behind the next following gland G and ready the actuator for its subsequent two-stage intermittent extension. Actuators 32 and 32' are integrated into the machine's main program and control system, along with cylinders 24–27 and controlled systems employed in the filling station (e.g., fill tube 14), in a manner well-known to those skilled in the packaging arts. As shown in FIG. 1, the open ends of glands G can be capped prior to movement of the bags to the filling station with the caps removed by suitably apparatus (not shown) prior to filling by fill tube 14. A detailed description of actuators 32 and 32' can be found in U.S. Pat. No. 4,488,477, also incorporated by reference herein.

I claim:

1. A machine for moving at least one pair of bags along a path disposed in a horizontal plane and for then cutting said bags from each other, said bags being connected together at a severable parting line extending transversely relative to said path, said machine comprising a frame, conveyor means mounted on said frame for intermittently moving said pair of bags along said path, first and second platens mounted on said frame and spaced apart in the direction of said path to define an opening between said platens, extending transversely relative to said path, clamping means movably mounted above said platens for engaging and clamping a leading end of a trailing bag and a trailing end of a leading bag of said pair of bags to said first and second platens, respectively, to position the severable parting line, connecting said pair of bags together, over said opening, said cutting means, including a cutting blade, mounted on said frame for severing the parting line connecting said pair of bags together by moving said cutting blade in said horizontal plane and transversely through said opening.

2. The machine of claim 1 wherein an upstream end of said second platen is spaced vertically below said first platen.

3. The machine of claim 1 wherein said clamping means comprises first clamping bar means extending over said first platen, transversely relative to said path, for engaging and clamping the leading end of said trailing bag to said first platen and second clamping bar means extending over said second platen in parallel relationship relative to said first clamping bar means for engaging and clamping the trailing end of said leading bag to said second platen, and actuating means for selectively raising or lowering said first and second clamping bar means into clamping engagement with said pair of bags.

4. The machine of claim 3 wherein said first clamping bar means comprises a pair of laterally spaced first clamping bars extending in alignment over said first platen and a pair of laterally spaced second clamping bars extend in alignment over said second platen and wherein said actuating means comprises an extensible and retractable fluid actuated cylinder mounted on said frame and connected to each of said first and second clamping bars.

5. The machine of claim 4 wherein each of said bags has a filling gland secured thereto and further comprising guide means overlying said first and second platens and extending in the direction of said path for engaging and guiding said gland therealong, said guide means positioned laterally between said first and second pairs of said clamping bars.

6. The machine of claim 4 wherein each said cylinder is mounted on a support bar secured in cantilevered relationship on said frame to extend over a respective one of said platens.

7. The machine of claim 6 further comprising means interconnected between each said support bar and a respective one of said first and second pairs of clamping bars for preventing swinging movements thereof about an axis of a respective one of said cylinders.

8. The machine of claim 6 wherein a first pair of said cylinders connected to a first one of said first clamping bars and to a first one of said second clamping bars are both mounted on a first one of said support bars and wherein a second pair of said cylinders connected to a second one of said first clamping bars and to a second one of said second clamping bars are both mounted on a second one of said support bars.

9. The apparatus of claim 1 wherein each of said bags has a filling gland secured thereto and further comprising guide means overlying said first and second platens and extending in the direction of said path for engaging and guiding said gland therealong and said conveyor means comprises extendable and retractable actuating means for engaging and intermittently moving said gland along said guide means.

10. The apparatus of claim 9 wherein said conveyor means further comprises hook means pivotally mounted on said actuating means to engage and move said gland when said actuating means is extended in the direction of said path and to pivot upwardly away from said guide means for engagement with a next-following gland when said actuating means is retracted.

11. The machine of claim 1 wherein said cutting means further comprises actuating means for intermittently moving said cutting blade transversely through said opening from a first side of said platens to a second side of said platens for severing said parting line.

12. The machine of claim 11 wherein said actuating means comprises an actuator mounted below said first and second platens, said cutting blade attached to said actuator.

* * * * *